US007225814B2

(12) United States Patent
Barclay

(10) Patent No.: US 7,225,814 B2
(45) Date of Patent: Jun. 5, 2007

(54) NAIL POLISH REMOVER KIT

(76) Inventor: Debra Barclay, 17935 Holly Brook Dr., Tampa, FL (US) 33647

( * ) Notice: Subject to any disclaimer, the term of this patent is extended or adjusted under 35 U.S.C. 154(b) by 2 days.

(21) Appl. No.: 11/235,129

(22) Filed: Sep. 27, 2005

(65) Prior Publication Data

US 2006/0076029 A1 Apr. 13, 2006

Related U.S. Application Data

(60) Provisional application No. 60/616,435, filed on Oct. 7, 2004.

(51) Int. Cl.
*A45D 29/18* (2006.01)
*A45D 33/00* (2006.01)
*A46B 11/00* (2006.01)
*A46B 17/08* (2006.01)

(52) U.S. Cl. ..... 132/74.5; 401/122; 401/130

(58) Field of Classification Search ..... 132/73.5, 132/74.5, 75, 73; 401/126–130, 18, 123, 401/134, 133, 15, 205, 122, 121; D28/56–59
See application file for complete search history.

(56) References Cited

U.S. PATENT DOCUMENTS 1,607,702 A * 11/1926 Siline et al. ..... 401/15
4,282,891 A 8/1981 Duceppe
4,440,181 A 4/1984 Scherer
4,446,965 A * 5/1984 Montiel ..... 206/205
4,474,195 A 10/1984 Warner
5,897,262 A 4/1999 Bratby-Carey
6,155,270 A 12/2000 Samiean
6,314,965 B1 11/2001 Walker
7,066,675 B1 * 6/2006 Miller ..... 401/126
2001/0003735 A1 6/2001 Perlman
2003/0081980 A1 5/2003 Moga
2005/0232681 A1 * 10/2005 Gueret ..... 401/129

* cited by examiner

*Primary Examiner*—Robyn Doan
(74) *Attorney, Agent, or Firm*—Richard C. Litman

(57) ABSTRACT

The nail polish remover kit is a kit that provides a clean, thorough, and efficient way of removing nail polish from both fingernails and toenails. The kit includes a jar filled with nail polish remover solution, a sponge-like filler inside the jar for absorbing a portion of the solution, and a removable lid with an attached wand having a dauber and a scraper. The solution-saturated filler has vertical slits that allow the user to remove polish from a fingernail, while the jar lid with integrated wand and attached dauber provides for removing polish from toenails and other harder to reach spots. The tip of the wand is provided with a sharpened edge for scraping off excess polish after the removal process has been completed.

7 Claims, 9 Drawing Sheets

NAIL POLISH REMOVER KIT

CROSS-REFERENCE TO RELATED APPLICATION

This application claims the benefit of U.S. Provisional Patent Application Ser. No. 60/616,435, filed Oct. 7, 2004.

BACKGROUND OF THE INVENTION

1. Field of the Invention

The present invention relates to nail polish remover kits, and more specifically, to a nail polish remover kit that provides the user with a way to effectively remove nail polish from both fingers and toes.

2. Description of the Related Art

Women have applied nail polish to their fingernails and toenails for centuries. Modern nail polish formulations, however, can be difficult to remove when the polish becomes faded, or when it is desired to change the color of the polish or the decorations applied thereto, or simply to clean the nails. Most frequently, the process of removing nail polish from the fingernails and toenails requires the purchase of several items. Round jars containing a sponge imbued with nail polish remover are available for removing nail polish from the fingernails. The sponge has slits defined therein so that each fingernail may be separately inserted into the sponge to soak off the nail polish.

However, this jar and sponge combination cannot be used to remove nail polish from toenails, since it is not feasible to separately insert each toe into the slits defined in the sponge. Consequently, a bottle of nail polish remover and cotton balls are used to wipe nail polish from the toenails. The process is messy and impractical, and sometimes the open bottle of nail polish remover is accidentally knocked over so that the polish remover is spilled onto carpeting, or the wetted cotton balls become stuck to the user's fingernails as they attempt to apply the remover to their toenails, etc. Whether removing nail polish from fingernails or toenails, it is often necessary to have a nail file handy to scrape the last traces of nail polish from the edges of the nails and crevices between the nail and finger. The need to have all of these supplies for the simple task of removing nail polish can not only be costly, but can take up valuable counter and/or travel space.

It would therefore be desirable to provide a single product that includes everything required to remove nail polish from both fingernails and toenails. Thus, a nail polish remover kit solving the aforementioned problems is desired.

SUMMARY OF THE INVENTION

The nail polish remover kit provides a neat and efficient way of completely removing nail polish from both the fingernails and toenails of the user. The nail polish remover kit includes a jar for holding a liquid nail polish remover solution, a sponge-like, open cell filler inside the jar for absorbing a portion of the solution, and a removable lid with an attached wand having either a permanent or replaceable dauber and a scraper.

The filler, which is saturated with the nail polish remover solution, has a series of vertical slits for receiving the tip of a finger. While inside the solution-saturated filler, the polished fingernail comes in intimate contact with the nail polish remover solution and the surface of the filler for effectuating the removal of the polish from the nail. However, it is impractical for nail polish to be removed from a toenail in the same fashion. Thus, the lid with attached wand is provided for use on toenails.

In one embodiment, a hollow cylindrical tube located in the center of the jar has slots that allow the nail polish remover solution to flow into and remain inside the tube. The tube and a corresponding bore in the filler make it possible for the wand and a dauber that is attached to the end of the wand to rest inside the solution-filled jar while the lid is in a closed position over the jar, resulting in the saturation of the dauber with the solution. As the lid is removed, the wand and the attached dauber are removed from the solution filled tube and the dauber is relieved of excess solution by a tapered upper end or narrowed opening of the tube. The saturated dauber can then be used to apply remover solution, without the worry of run-off, to either the user's fingernails or toenails and, by rubbing the dauber over the desired nail, effectuate the removal of the nail polish.

The jar lid can also have a knob extending from its top surface. The knob makes it easier for the user to remove the lid and control the action of the wand and attached dauber while trying to remove polish from the hands and feet.

In another embodiment, the filler has a cylindrical bore defined therein for accommodating the wand and dauber, and the jar is closed by a two-piece lid including a lower, wide diameter portion that is removed for cleaning the fingernails, and an upper, narrow diameter lid that the wand is attached to and that threads onto the wide diameter lid at a hollow neck that extends upward from the top of the wide diameter lid. The hollow neck is dimensioned so that the dauber is squeezed of excess solution by the wide diameter lid as the narrow diameter lid and attached wand are removed. This arrangement allows the user to remove only the smaller diameter lid and attached wand when only the user's toenails need to be cleaned.

A sharpened edge is provided at the end of the wand. This sharpened edge provides a scraping function for the removal of nail polish that has collected around the cuticle area or otherwise was not removed through use of the filler or the dauber. The end of the wand may be slightly curved or angled to further effectuate the removal of the nail polish.

In any of the above-discussed embodiments, it is possible for the dauber to be removably attached to the end of the wand in any number of ways. In one embodiment, the wand is equipped with a loop opening that allows a replaceable dauber to be threaded through the loop and secured into place. In another embodiment, the wand is equipped with a tensioned two-prong tip for securing the dauber in place.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
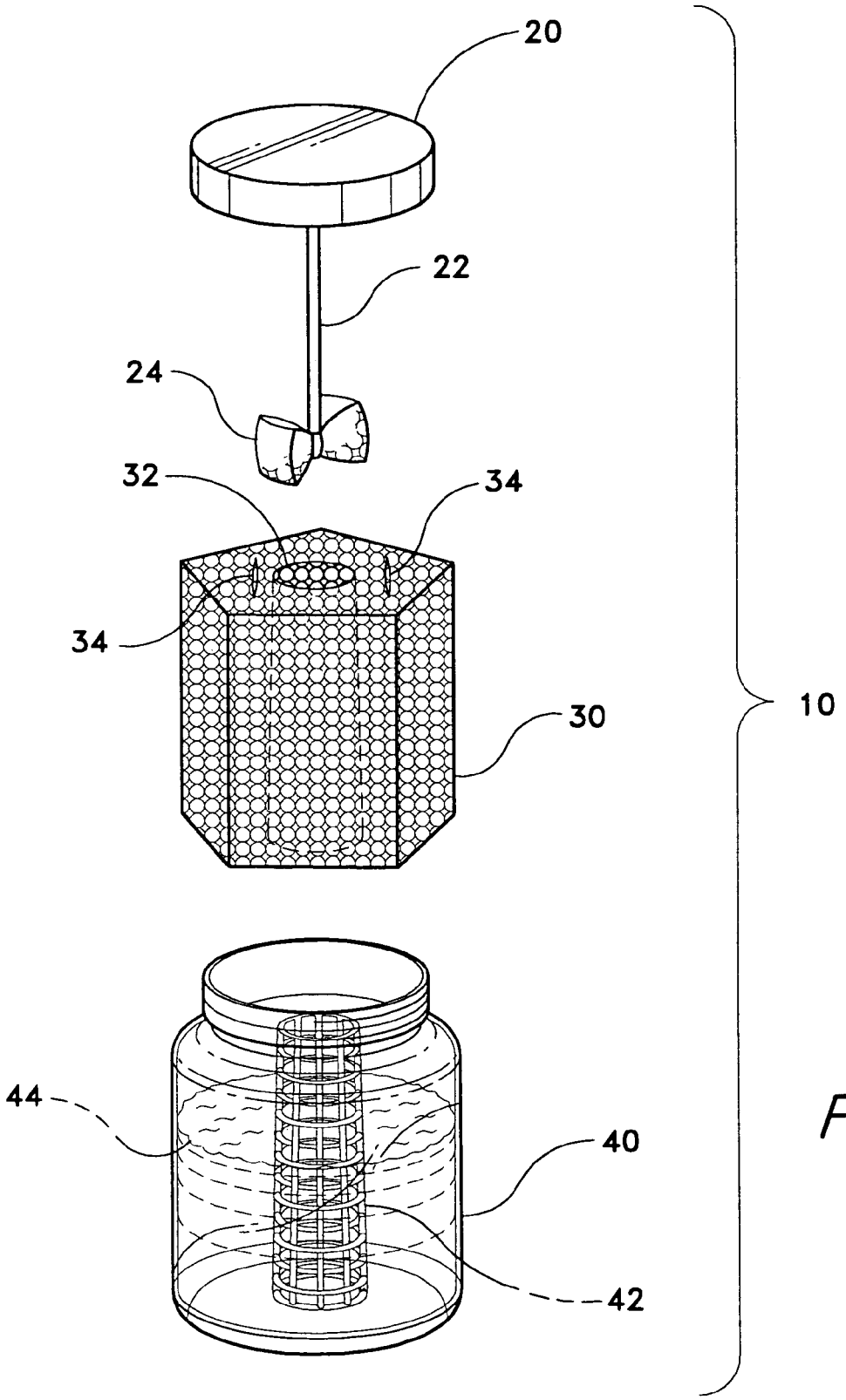
FIG. 1 is an exploded, perspective view of a nail polish remover kit according to the present invention.

The present invention is a nail polish remover kit, designated generally as 10 in the drawings.

Referring to FIG. 1 of the drawings, the nail polish remover kit 10 includes a jar 40, filler 30, and lid 20. In this embodiment, jar 40 has an incorporated cylindrical tube 42 and houses nail polish remover solution 44. Cylindrical tube 42 has a series of slots that allow remover solution 44 to flow into the interior volume of tube 42. Cylindrical tube 42 tapers slightly, decreasing in diameter from the bottom of jar 40 toward the top of jar 40. Filler 30 is housed inside jar 40 and has a bore 32 therethrough that corresponds to cylindrical tube 42. Filler 30 also has a plurality of finger receiving slits 34 in its upper end that extend downwardly into filler 30. Lid 20 is removably secured over jar 40 and has an incorporated wand 22. Wand 22 has a removably attached dauber 24. Filler 30 may be made of a sponge-like material, so that it may be partially saturated with remover solution 44 when it is placed inside jar 40. Dauber 24 may be made of a semi-saturable and resilient material, such as a foam material or sponge material, so that it may be used many times before needing replacement.

Figure 2:
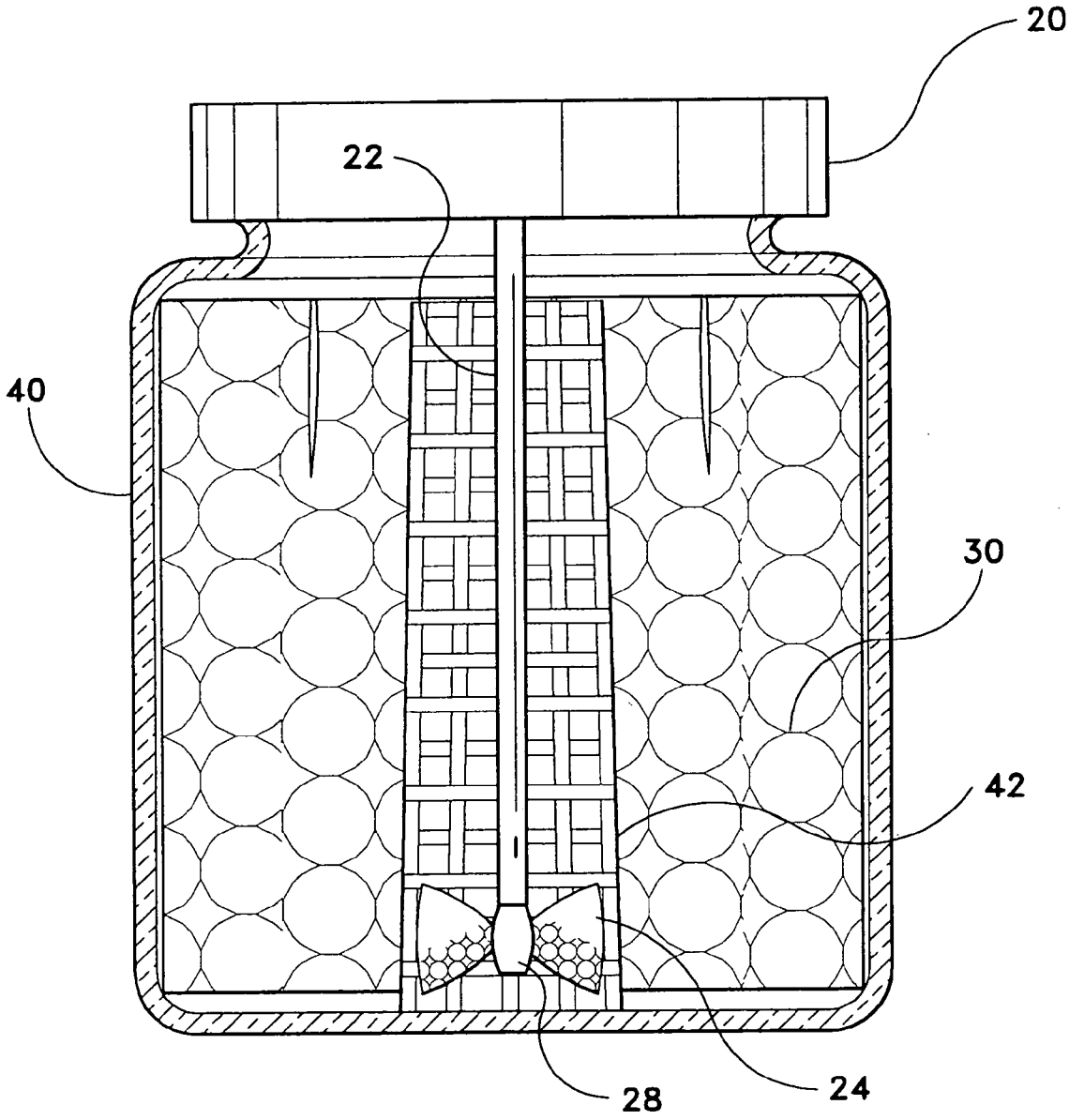
FIG. 2 is an elevation view of the nail polish remover kit according to the present invention, shown partially in section.

Turning now to FIG. 2, filler 30 is shown tightly constrained inside jar 40 and lid 20 is in a closed position over jar 40. While lid 20 is in the closed position over jar 40, wand 22 and dauber 24 are disposed inside cylindrical tube 42 and soak in the remover solution. Dauber 24 is sized to fit closely within the diameter of cylindrical tube 42 so that dauber 24 is relieved of any excess solution at the tapered top end of cylindrical tube 42 as it is pulled from jar 40 by removing the lid 20 and incorporated wand 22.

Figure 3:
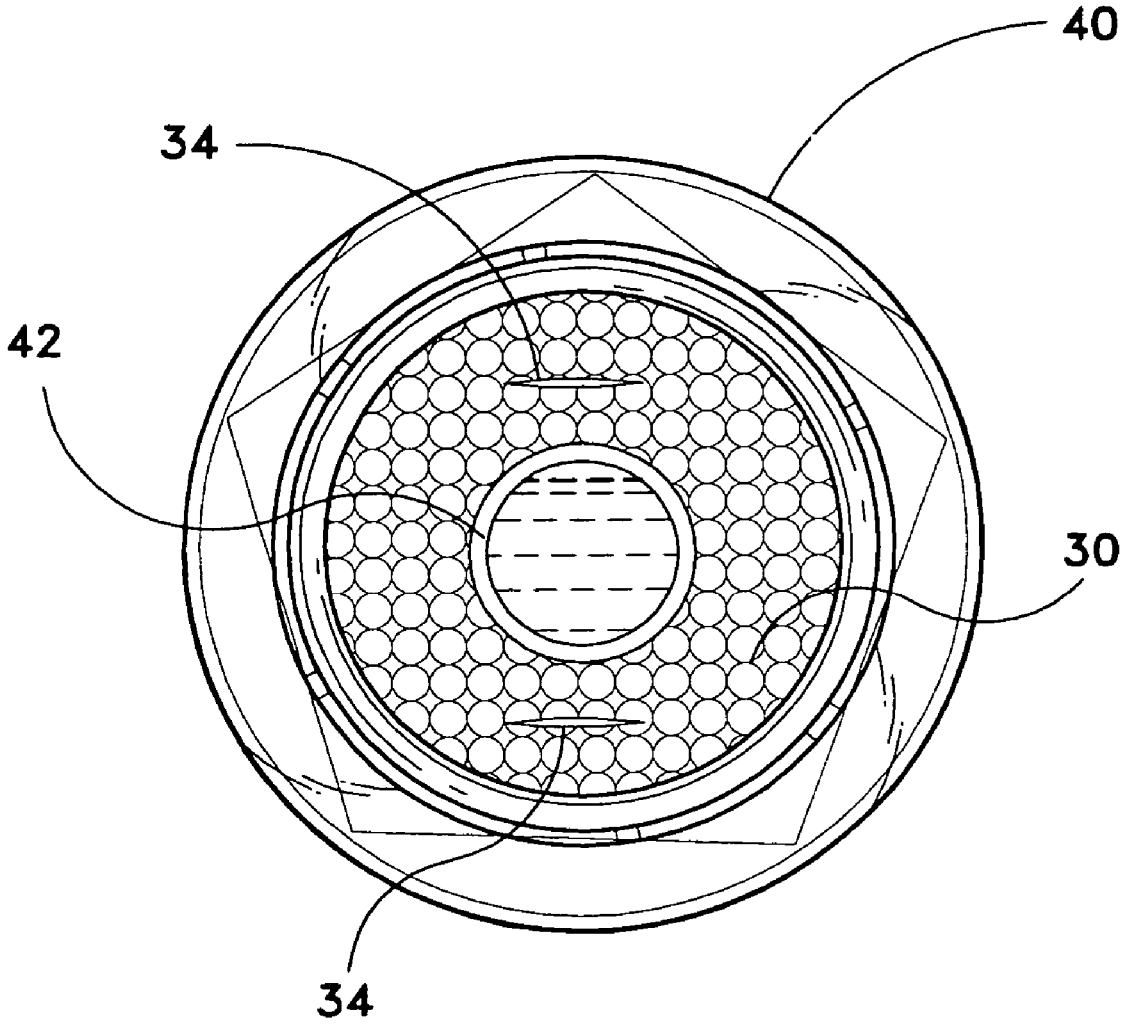
FIG. 3 is a top view of a kit jar with the inserted filler according to the present invention, the lid being removed.

FIG. 3 of the drawings shows jar 40 with inserted filler 30. Filler 30 is shaped to fit tightly inside jar 40 so that portions of filler 30 come into constant contact with the sidewalls of jar 40. Finger receiving slits 34 are defined in the top surface of filler 30 outside the circumference of cylindrical tube 42. The cross-sectional shape of the filler 30 may be hexagonal, pentagonal, circular with axial grooves, or any other desired shape that comes into contact with the jar at intervals, but leaves sufficient space for excess nail polish remover solution.

Figure 4:
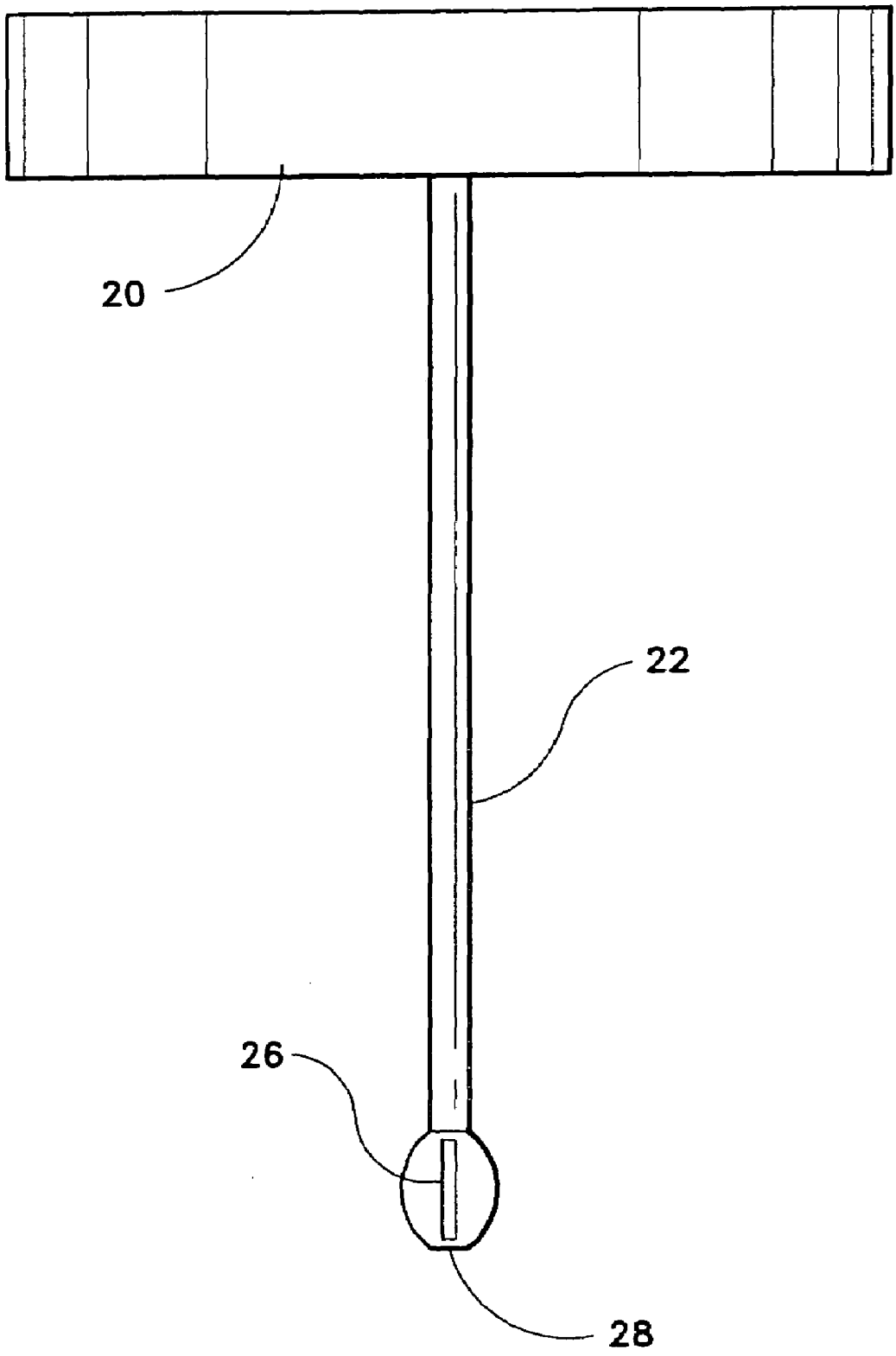
FIG. 4 is an elevation view of an embodiment of the lid of the nail polish remover kit according to the present invention, the dauber being removed to show details of the end of the wand.
Figure 5:
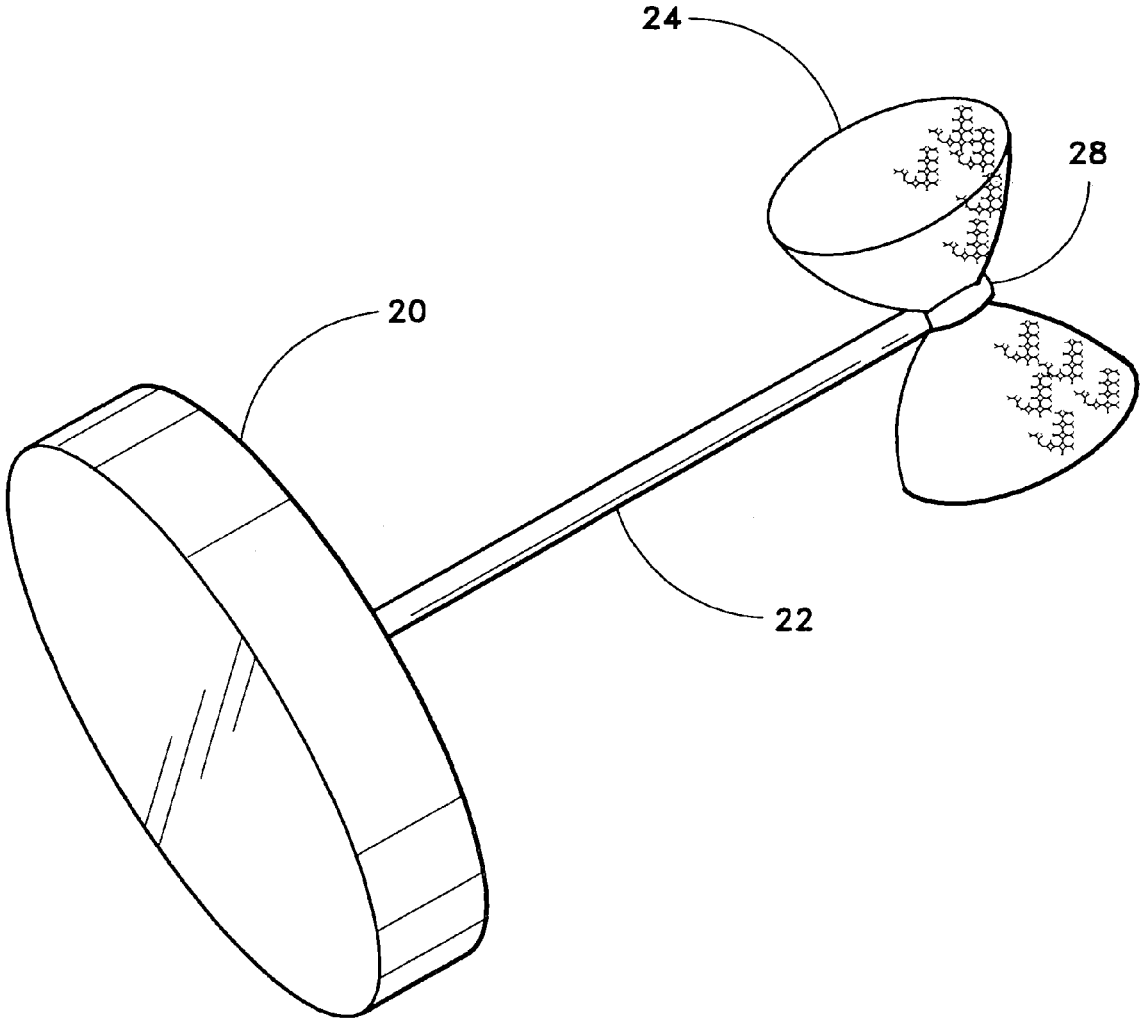
FIG. 5 is a perspective view of an embodiment of the lid element of the nail polish remover kit according to the present invention with attached wand and dauber.

FIG. 4 and FIG. 5 of the drawings show lid 20. Lid 20 has an incorporated wand 22 extending from the bottom surface of lid 20 and culminating in sharpened edge 28. Wand 22 has a loop opening 26 near the distal end for receiving dauber 24. Loop opening 26 and dauber 24 are sized so that dauber 24 is held tightly inside loop opening 26 at the bottom of wand 22, yet dauber 24 is capable of being replaced when needed. Sharpened edge 28 is provided as a means for a scraper to help remove additional nail polish that may not have been removed through ordinary use of the kit. The distal end of wand 22 may be slightly curved or angled to further effectuate the removal of the nail polish.

Figure 4A:
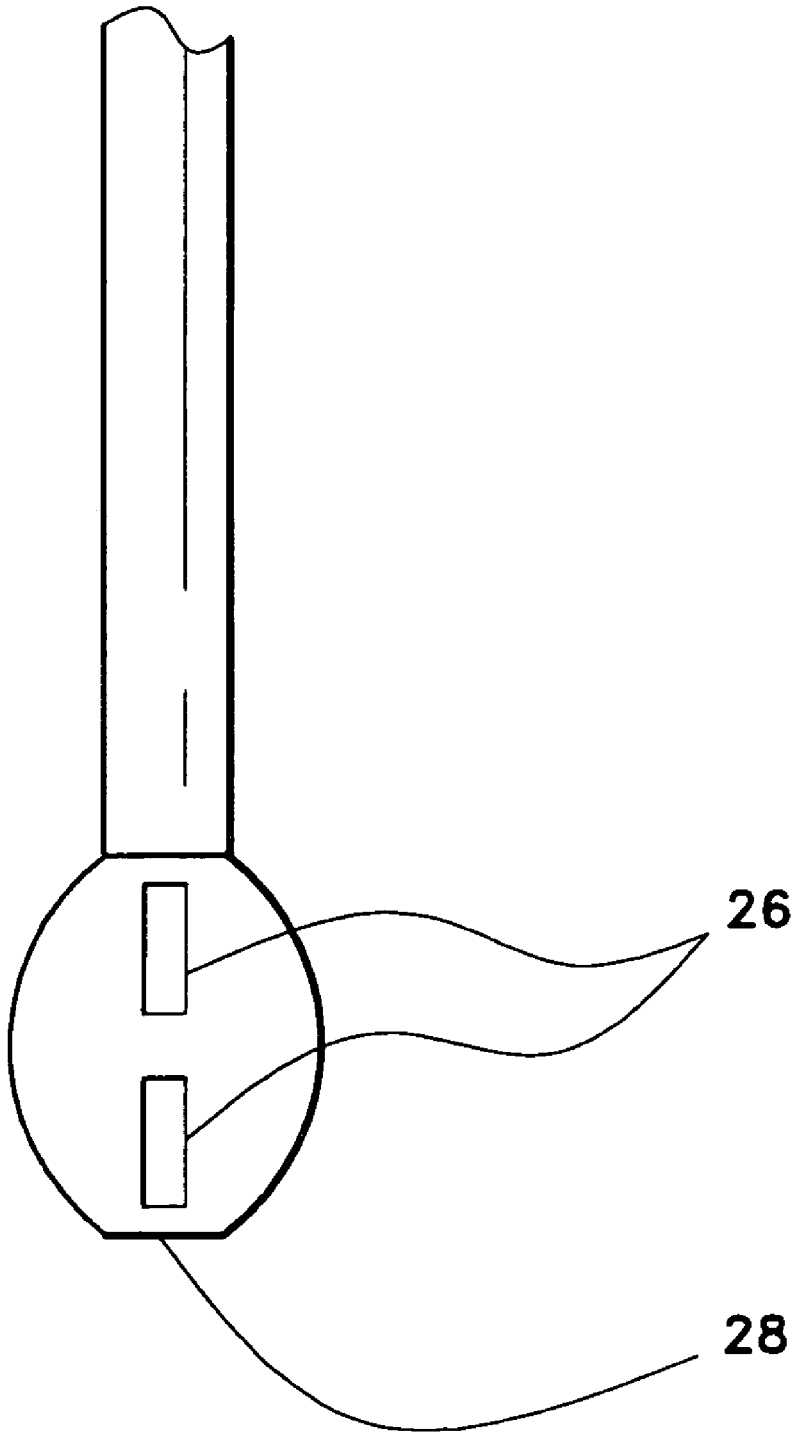
FIG. 4A is a partial view of another embodiment of the wand element of the nail polish remover kit according to the present invention, the dauber being removed to show details of the end of the wand.

FIG. 4A of the drawings shows an alternative embodiment of wand 22 having two loop openings 26 near the distal end for receiving one or more daubers 24.

Figure 6:
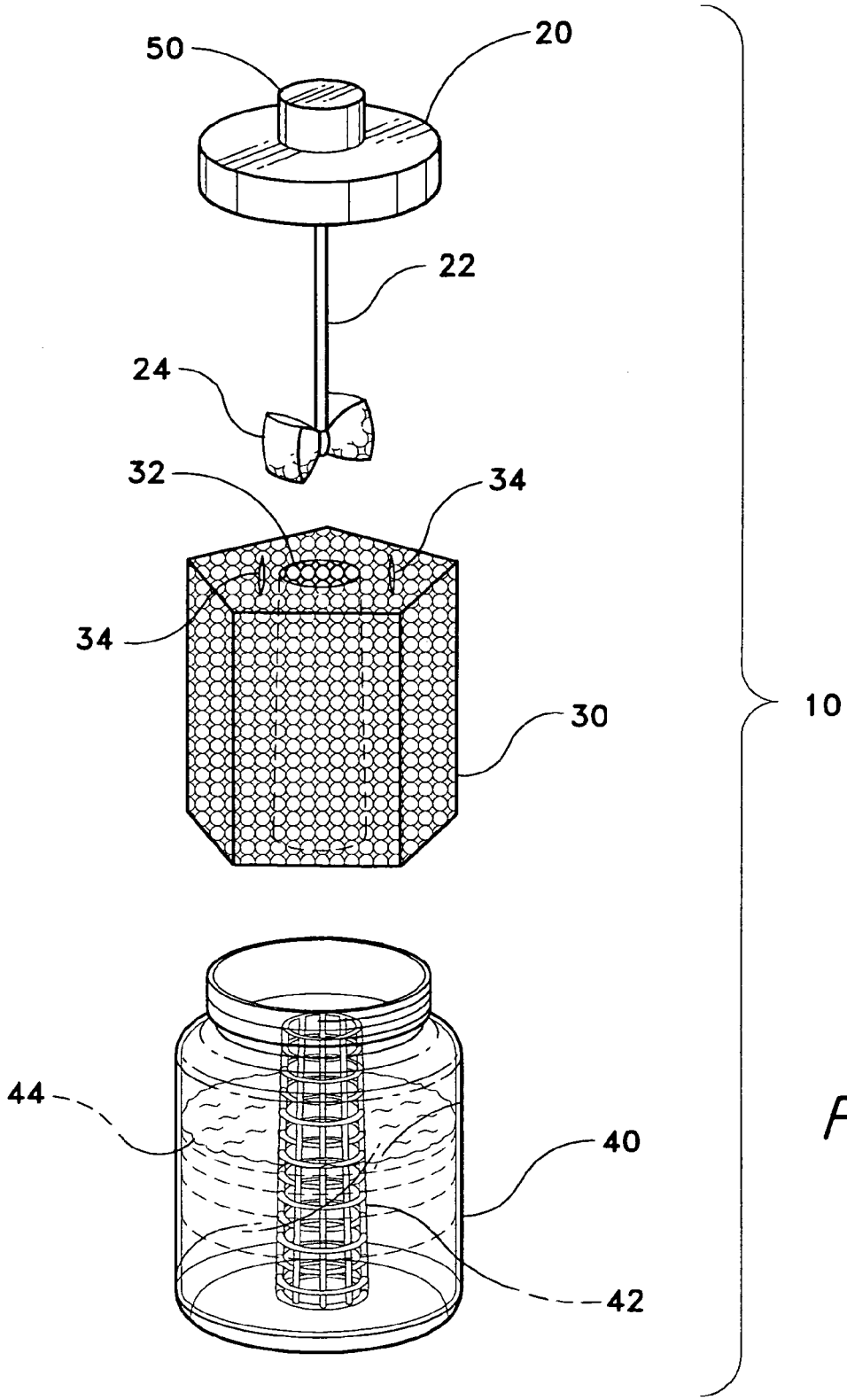
FIG. 6 is an exploded, perspective view of another embodiment of the nail polish remover kit according to the present invention.

FIG. 6 shows an alternative embodiment of the nail polish remover kit 10 with lid 20 having an attached knob 50 extending upward from the top surface of lid 20. Attached knob 50 provides the user an easier way of removing lid 20 from jar 40 and provides greater control of wand 22 and dauber 24 when using kit 10 for its intended purpose of removing nail polish from fingernails and toenails.

Figure 7:
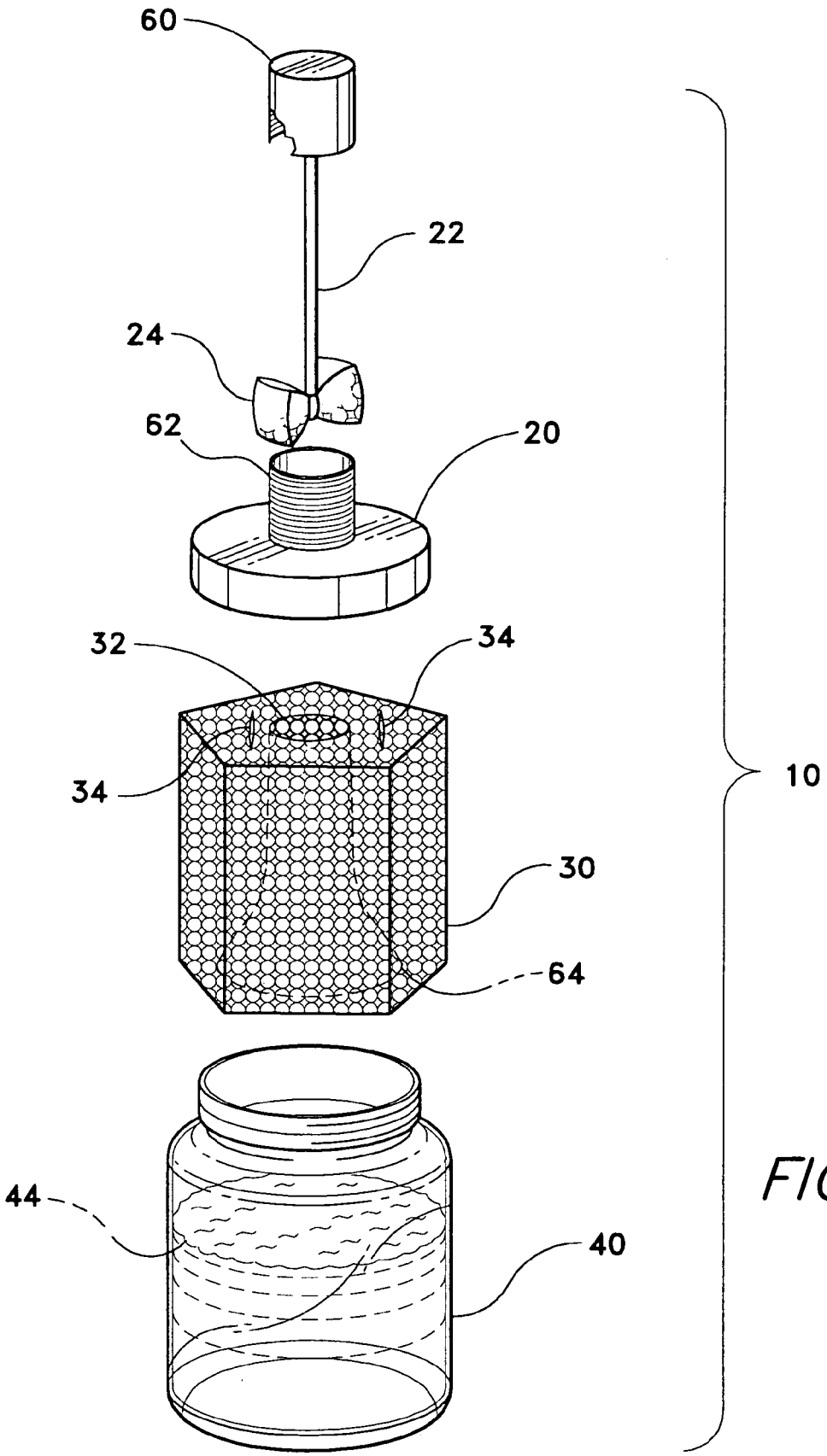
FIG. 7 is an exploded perspective view of a further embodiment of a nail polish remover kit according to the present invention.

FIG. 7 shows another alternative embodiment of nail polish remover kit 10 with lid 20 having a centrally located hollow neck 62 extending from the top surface of the lid 20. Hollow neck 62 is aligned with, and provides access to, a centrally located bore through lid 20, allowing wand 22 and dauber 24 access to jar 40. Wand 22 and dauber 24 are attached to a smaller diameter lid 60. Smaller diameter lid 60 has an internally threaded portion for being removably connected to lid 20 along an externally threaded portion of hollow neck 62. This embodiment allows the user to remove only smaller diameter lid 60 for access to wand 22 and dauber 24 without the need for removing entire lid 20. Hollow neck 62 has a smaller diameter than resilient dauber 24, so that excess nail polish remover is squeezed out of the dauber 24 when the wand is removed from the jar 40. In this embodiment, there is no need for the cylindrical tube extending from the bottom of the jar 40. Rather, the filler 30 simply has a cylindrical bore 32 having a widened lower portion 64 and a diameter wide enough to accommodate dauber 24 and long enough to accommodate wand 22.

Figure 7A:
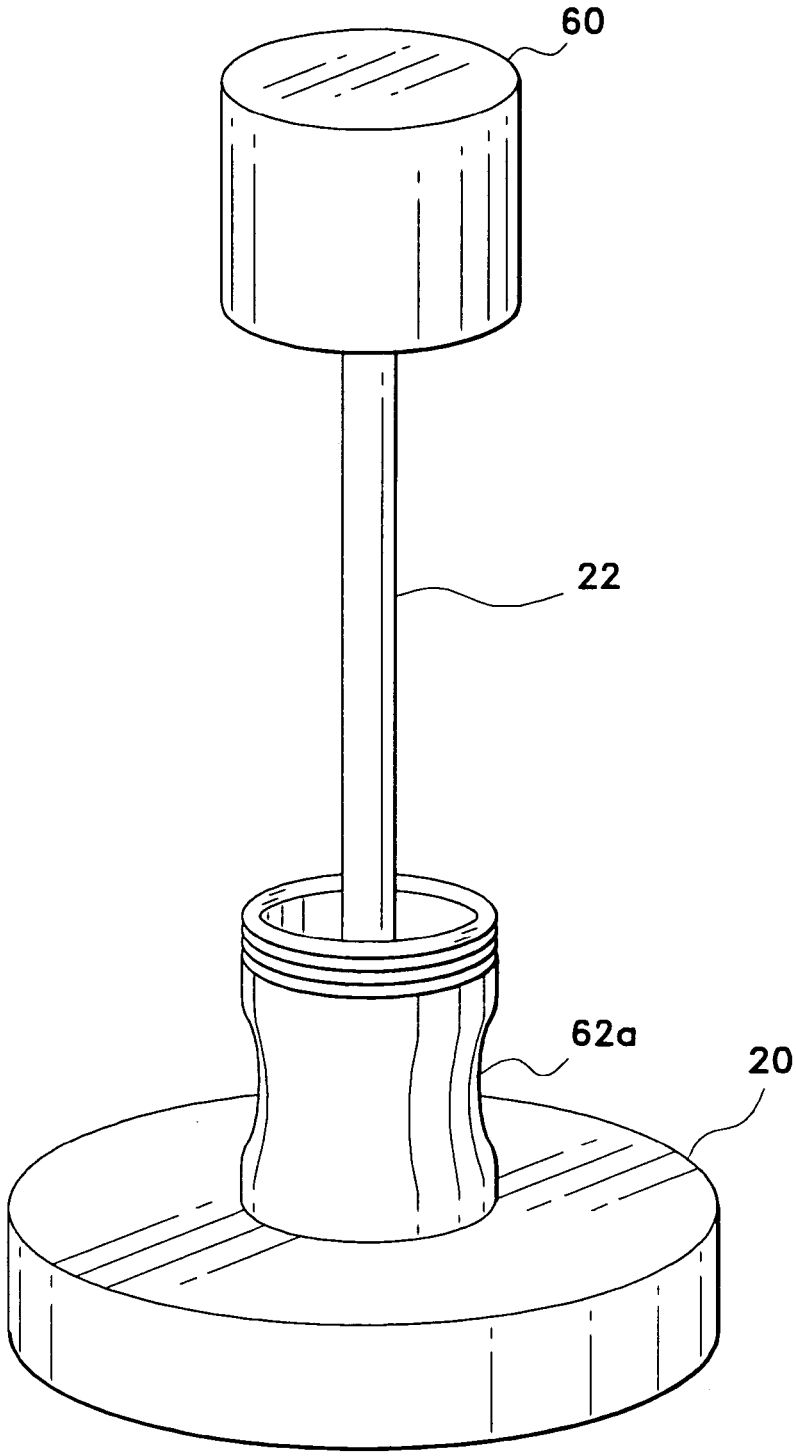
FIG. 7A is a perspective view of an alternative embodiment of a lid element with an integral neck of the nail polish remover kit according to the present invention.

FIG. 7A shows an alternative embodiment of the hollow neck 62*a*. Hollow neck 62*a* has a narrowed middle section that provides for added squeezing of the dauber as wand 22 is removed from the jar containing the nail polish remover solution.

It is to be understood that the present invention is not limited to the embodiments described above, but encompasses any and all embodiments within the scope of the following claims.

I claim:

1. A nail polish remover kit, comprising:

a jar having a bottom wall and at least one sidewall extending from the bottom wall, the sidewall defining a mouth of the jar;

a tube extending from the bottom wall and having an open upper end, the tube having a plurality of slots defined therein, the tube having a narrowed diameter at the upper end;

an open cell, resilient filler disposed in the jar and encircling the tube, the filler having at least one slit defined therein adapted for receiving a user's fingernails;

a lid removably attached to the mouth of the jar;

a wand depending from the lid, the wand having a distal end with a sharpened edge, the wand being aligned for insertion into the tube;

a resilient dauber, the dauber being removably attached to the wand at the distal end of the wand, the dauber having a diameter slightly greater than the upper end of the tube so that the dauber is compressed when the wand is withdrawn from the tube; and a volume of nail polish remover solution disposed in the jar saturating the filler and the dauber.

2. The nail polish remover kit according to claim 1, further comprising a knob attached to the lid.

3. The nail polish remover kit according to claim 1, wherein the wand has at least one aperture defined in the distal end, the dauber being inserted through the aperture in order to attach the dauber to the wand.

4. A nail polish remover kit, comprising:

a jar having a bottom wall and at least one sidewall extending from the bottom wall, the sidewall defining a mouth of the jar;

an open cell, resilient filler disposed in the jar and having a central bore extending axially therethrough and at least one slit defined therein adapted for receiving a user's fingernail;

a large diameter lid removably attached to the mouth of the jar, the lid having a centrally located hollow neck extending therefrom defining a centrally located bore through the large diameter lid, the bore in the lid being aligned with the bore in the filler;

a small diameter lid removably attached to the hollow neck and closing the bore defined in the large diameter lid;

a wand extending from the small diameter lid and having a distal end with a sharpened edge, the wand being aligned for insertion into the central bore defined in the filler, wherein the wand has at least one aperture defined in the distal end, the dauber being inserted through the aperture in order to attach the dauber to the wand;

a resilient dauber removably attached to the distal end of the wand, the dauber having a diameter slightly greater than the hollow neck extending from the large diameter lid, whereby the dauber is compressed upon being withdrawn from the jar; and a volume of nail polish remover solution disposed in the jar saturating the filler and the dauber.

5. The nail polish remover kit according to claim 4, wherein the bore in the filler has tapers in diameter from wide to narrow as the bore extends from the bottom wall of the jar to the mouth of the jar.

6. The nail polish remover kit according to claim 4, wherein the hollow neck has external threads.

7. The nail polish remover kit according to claim 6, wherein the small diameter lid has internal threads corresponding to the external threads on the hollow neck.

* * * * *